US009254973B2

(12) United States Patent
Ishida et al.

(10) Patent No.: US 9,254,973 B2
(45) Date of Patent: Feb. 9, 2016

(54) IMAGE FORMING APPARATUS

(71) Applicant: CANON KABUSHIKI KAISHA, Tokyo (JP)

(72) Inventors: Toshiki Ishida, Kashiwa (JP); Yoshinao Chiba, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/525,507

(22) Filed: Oct. 28, 2014

(65) Prior Publication Data

US 2015/0115521 A1 Apr. 30, 2015

(30) Foreign Application Priority Data

Oct. 31, 2013 (JP) ..... 2013-227164

(51) Int. Cl.
*B65H 1/18* (2006.01)
*B65H 1/14* (2006.01)
*B65H 7/02* (2006.01)

(52) U.S. Cl.
CPC .. *B65H 1/18* (2013.01); *B65H 1/14* (2013.01); *B65H 7/02* (2013.01); *B65H 2511/152* (2013.01); *B65H 2513/108* (2013.01); *B65H 2513/50* (2013.01)

(58) Field of Classification Search
CPC ..... B65H 1/18; B65H 2511/152; B65H 2513/108
See application file for complete search history.

(56) References Cited

U.S. PATENT DOCUMENTS

| | | | | |
|---|---|---|---|---|
| 4,235,432 | A * | 11/1980 | Marschke | 271/11 |
| 6,485,013 | B2 * | 11/2002 | Slippy et al. | 271/117 |
| 8,469,506 | B2 | 6/2013 | Uchida et al. | |
| 8,651,477 | B2 | 2/2014 | Chiba | |
| 8,746,875 | B2 | 6/2014 | Uchida et al. | |
| 2013/0221607 | A1 * | 8/2013 | Chiba | 271/117 |

FOREIGN PATENT DOCUMENTS

JP 2000-289861 A 10/2000

* cited by examiner

*Primary Examiner* — Michael McCullough
(74) *Attorney, Agent, or Firm* — Fitzpatrick, Cella, Harper & Scinto

(57) ABSTRACT

An image forming apparatus includes: a sheet storage portion having a sheet stacking portion, a sheet feed portion, a drive portion configured to be capable of switching a lifting speed when lifting the sheet stacking portion between a first lifting speed and a second lifting speed, a height detecting portion configured to be capable of detecting the fact that the sheet reaches a decelerating position for switching the lifting speed of the sheet stacking portion from the first lifting speed to the second lifting speed, a time counting portion, and a control unit. The control unit computes the sheet stacking amount of the sheet stacking portion by using a relationship among the lifting time from a start of the lifting operation of the sheet stacking portion until the sheet reaches a decelerating position, the first lifting speed, and a heightwise position of the decelerating position when the sheet stacked on the sheet stacking portion is lifted to the decelerating position at the first lifting speed by the drive portion and then is lifted to a feeding position at the second lifting speed.

11 Claims, 11 Drawing Sheets

IMAGE FORMING APPARATUS

BACKGROUND OF THE INVENTION

1. Field of the Invention

This disclosure relates to an image forming apparatus capable of computing a stacking amount of sheets stored in a sheet storage portion.

2. Description of the Related Art

An image forming apparatus of the related art such as printers, copying machines, and facsimiles is provided with a sheet feeding apparatus configured to send forth a sheet stored in a sheet storage portion demountably mounted on an image forming apparatus body by a sheet feed portion such as a pickup roller and feed the sheet to an image forming portion. Examples of the sheet feeding apparatus include a sheet stacking portion provided in the sheet storage portion so as to be movable upward and downward, and configured to, when feeding the sheet, lift the sheet stacking portion to press the sheet against the sheet feed portion and, in this state, rotate the sheet feed portion to feed the sheet.

In the sheet feeding apparatus, the height of a topmost sheet stacked in the sheet stacking portion needs to be maintained at a predetermined height allowing the sheet feed portion to feed the sheet. Therefore, an elevating portion configured to move the sheet stacking portion upward and downward is provided in the sheet storage portion, and the image forming apparatus body is provided with a drive portion and a drive transmitting mechanism configured to transmit drive of the drive portion to drive the elevating portion. When the height of the topmost sheet is lowered, the drive portion is driven, the drive of the drive portion is transmitted to the elevating portion by the drive transmitting mechanism to lift the sheet stacking portion, and the height of the topmost sheet is maintained at a predetermined height allowing the sheet feeding.

The sheet feeding apparatus of this configuration includes a sheet surface position detection sensor configured to detect the height of the topmost sheet. When the sheet storage portion is set to the image forming apparatus body, the sheet feeding apparatus inspects a state of the sheet surface position detection sensor first, and if the sheet surface position detection sensor is OFF (non-detecting state), lifts the sheet stacking portion until the sheet surface position detection sensor is turned ON.

Japanese Patent Laid-Open No. 2000-289861 discloses a configuration adapted to count time from the start of lifting of the sheet stacking portion until the sheet surface position detection sensor is turned ON, and compute a sheet stacking amount in the sheet stacking portion, that is, the remaining amount on the basis of a counted value and a lifting speed of the sheet stacking portion. When computing the sheet stacking amount from a lifting time corresponding to time until the sheet surface position detection sensor is turned ON and a lifting speed in this manner, a control unit computes the stacking amount in accordance with an arithmetic expression for computing the sheet stacking amount set in advance. The arithmetic expression is generally expressed by a linear function as $H=-at+b$, where t is lifting time, and H is a stacking amount.

However, in the case where the relationship between the lifting time and the lifting speed varies in the middle of the upward movement, if the stacking amount is computed by the linear function, there arises a difference between the computed sheet stacking amount and an actual stacking amount, and accurate detection of the stacking amount is not achieved.

SUMMARY OF THE INVENTION

This disclosure provides an image forming apparatus including:

a sheet storage portion having a sheet stacking portion configured to stack sheets and to be movable upward and downward;

a sheet feed portion provided above the sheet storage portion and configured to feed the sheets;

a drive portion configured to be capable of lifting the sheet stacking portion until the sheets stacked in the sheet stacking portion reach a feeding position allowing the sheet feed portion to feed the sheets and configured to be capable of switching a lifting speed when lifting the sheet stacking portion to the feeding position between a normal speed and a reduced speed slower than the normal speed;

a height detecting portion configured to be capable of detecting the fact that the sheets reach a decelerating position where the lifting speed of the sheet stacking portion is switched from the normal speed to the reduced speed during a period from a start of lifting of the sheet stacking portion until the sheets stacked on the sheet stacking portion reach the feeding position;

a time counting portion configured to count a lifting time of the sheet stacking portion; and a computing portion configured to compute a sheet stacking amount of the sheet stacking portion by using a relationship among the lifting time from the start of lifting of the sheet stacking portion until the sheets stacked on the sheet stacking portion reach the decelerating position counted by the time counting portion, the normal speed, and a height of the decelerating position when the sheets are lifted to the decelerating position by the drive portion at the normal speed and then are lifted to the feeding position at the reduced speed.

Further features of the present invention will become apparent from the following description of exemplary embodiments with reference to the attached drawings.

BRIEF DESCRIPTION OF THE DRAWINGS

FIG. 6B is a drawing illustrating the sheet feeding apparatus of the embodiment with a small number of sheets stacked thereon and the stacking tray lifted so that the deceleration position detection sensor is turned ON.

DESCRIPTION OF THE EMBODIMENTS

Figure 1:
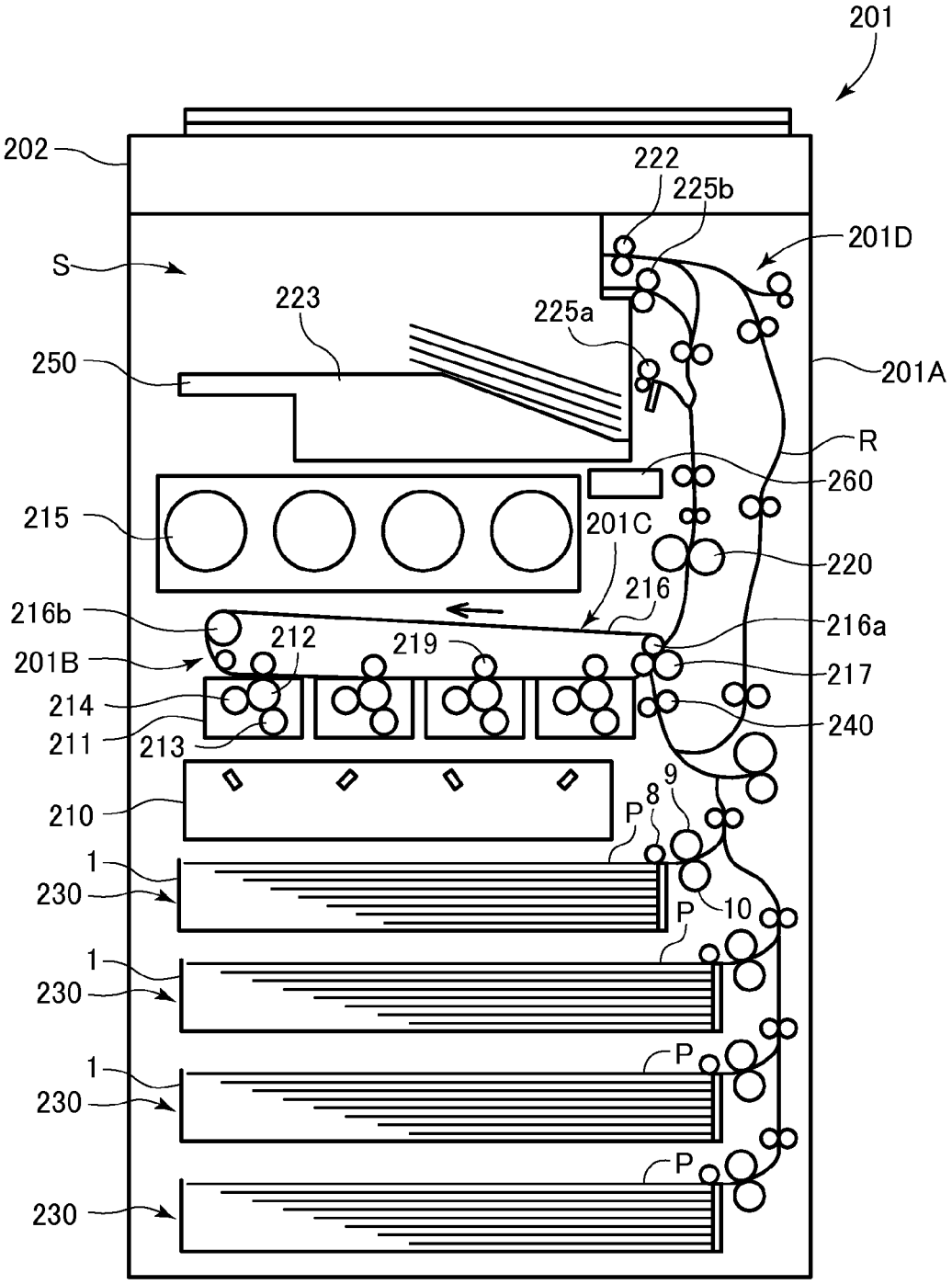
FIG. 1 is a drawing illustrating a schematic configuration of a full-color laser beam printer as an example of an image forming apparatus of an embodiment.

Hereinafter, a mode for carrying out this disclosure will be described in detail with reference to the drawings. FIG. 1 is a drawing illustrating a schematic configuration of a full-color laser beam printer as an example of an image forming apparatus according to an embodiment of this disclosure. In FIG. 1, reference numeral 201 denotes a full-color laser beam printer (hereinafter, referred to as "printer", reference numeral 201A denotes a printer body as an image forming apparatus body, and reference numeral 201B denotes an image forming portion configured to form an image on a sheet. Reference numeral 202 denotes an image reading portion installed above the printer body 201A substantially horizontally, and a discharge space S for discharging the sheet is formed between the image reading portion 202 and the printer body 201A.

Reference numeral 230 denotes a sheet feeding apparatus including a sheet feed cassette 1 as a sheet storage portion for storing a sheet P and configured to feed the sheet P from the sheet feed cassette 1. The sheet feeding apparatus 230 includes a pickup roller 8 as a sheet feed portion, and a separating portion including a feed roller 9 and a retard roller 10 for separating the sheets P fed from the pickup roller 8.

The image forming portion 201B as an image forming portion is of a four-drum full-color system, and includes a laser scanner 210, and four process cartridges 211 configured to form toner images in four colors of yellow (Y), magenta (M), cyan (C), and black (K). Each process cartridge 211 includes a photosensitive drum 212, a charger 213 as a charging portion, and a developer 214 as a developing portion. The image forming portion 201B includes an intermediate transfer unit 201C and a fixing portion 220 arranged above the process cartridge 211. Reference numeral 215 denotes a toner cartridge configured to supply toner to the developer 214.

The intermediate transfer unit 201C includes an intermediate transfer belt 216 wound around a drive roller 216*a* and a tension roller 216*b*. Primary transfer rollers 219 configured to abut against the intermediate transfer belt 216 at positions opposing the photosensitive drums 212 are provided inside the intermediate transfer belt 216. The intermediate transfer belt 216 in this case rotates in a direction indicated by an arrow by the drive roller 216*a* driven by a drive portion, not illustrated.

Respective color toner images having negative polarity on the photosensitive drums are transferred in sequence to the intermediate transfer belt 216 by the primary transfer roller 219 in an overlapped manner. At a position of the intermediate transfer unit 201C opposing the drive roller 216*a*, a secondary transfer roller 217 configured to transfer a color image formed on the intermediate transfer belt 216 to the sheet P is provided. In addition, the fixing portion 220 is arranged above the secondary transfer roller 217, and a first discharge roller pair 225*a*, a second discharge roller pair 225*b*, and a both-side inversing portion 201D are arranged at an upper left position of the fixing portion 220. The both-side inversing portion 201D includes an inverting roller pair 222 configured to rotate in a normal direction and a reverse direction, and a re-transporting passage R configured to convey the sheet on which the image is formed on one side again to the image forming portion 201B. In FIG. 1, reference numeral 260 denotes a control unit (computing portion) configured to control an image forming operation, a sheet feeding operation, and the like.

Subsequently, the image forming operation of the printer 201 will be described. First of all, when image information on a document is read by the image reading portion 202, the image information is subjected to image processing, then is converted into an electric signal, and transmitted to the laser scanner 210 of the image forming portion 201B. In the image forming portion 201B, surface of the photosensitive drums 212 charged uniformly to predetermined polarity and potential by the chargers 213 are exposed in sequence by a laser beam. Accordingly, electrostatic latent images of yellow, magenta, cyan, and black are formed in sequence on the photoconductive drums of the respective process cartridges 211.

Then, the electrostatic latent images are visualized by being developed by the toners of the respective colors and the respective color toner images on the respective photosensitive drums are overlapped and transferred in sequence on the intermediate transfer belt 216 by a primary transfer bias applied to the primary transfer roller 219. Accordingly, a toner image is formed on the intermediate transfer belt 216. In parallel to the toner image forming operation, the sheet P is fed from the pickup roller 8 provided in the sheet feeding apparatus 230. The fed sheet P is conveyed to a registration roller pair 240 after having separated piece by piece by the separating portion composed of the feed roller 9 and the retard roller 10, and a skew is corrected by the registration roller pair 240.

After having corrected the skew, the sheet P is conveyed to a secondary transfer portion by the registration roller pair 240, and in the secondary transfer portion, the toner image is transferred in a lump onto the sheet P by a secondary transfer bias applied to the secondary transfer roller 217. Subsequently, the sheet P to which the toner image is transferred is conveyed to the fixing portion 220, and the respective color toners are melted and mixed by being applied with heat and pressure in the fixing portion 220, so that a color image is fixed to the sheet P.

Subsequently, the sheet P having the image fixed thereon is discharged into the discharge space S by the first discharge roller pair 225*a* and the second discharge roller pair 225*b*, provided downstream of the fixing portion 220, and is stacked on a stacking portion 223 protruding from a bottom surface of the discharge space S. When forming an image on both sides of the sheet P, after the image has been fixed, the sheet P is conveyed to the re-transporting passage R by the inverting roller pair 222, and then conveyed again to the image forming portion 201B.

Figure 2:
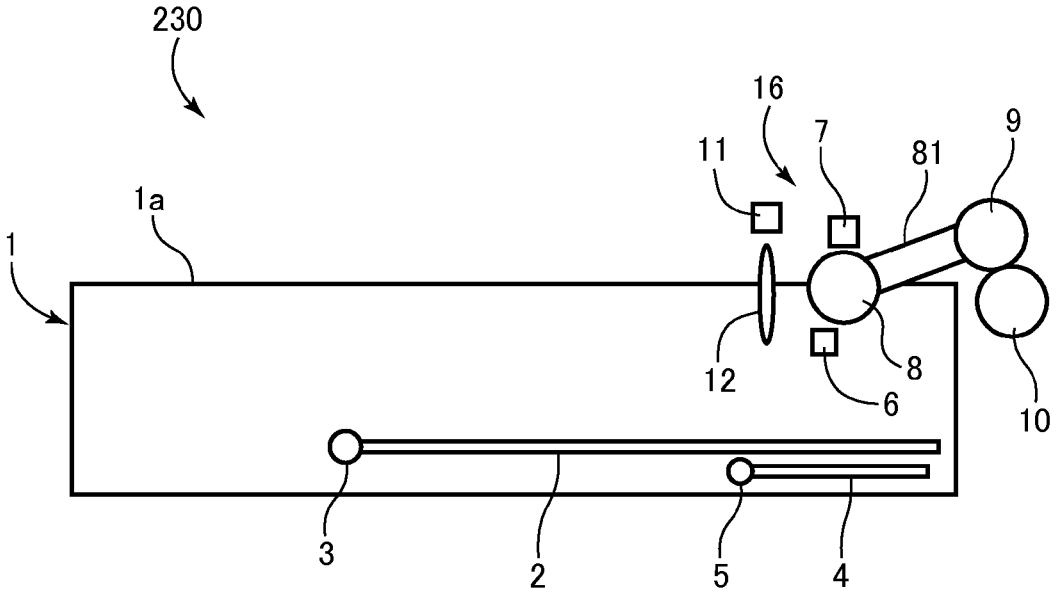
FIG. 2 is an explanatory drawing illustrating a configuration of a sheet feeding apparatus provided on the full-color laser beam printer of the embodiment.

FIG. 2 is an explanatory drawing illustrating a configuration of the sheet feeding apparatus 230 of the embodiment. In FIG. 2, reference sign 1*a* denotes a cassette body of the sheet feed cassette 1 demountably (drawably) mounted on the printer body 201A, reference sign denotes a stacking tray (middle plate) as the sheet stacking portion supported pivotably upward and downward about a supporting shaft 3 provided on the cassette body 1*a*. Reference sign 4 denotes an arm plate arranged below the stacking tray 2 capable of moving upward and downward, and configured to be pivotable to move the stacking tray 2 upward and downward. The arm plate 4 is pivoted upward and downward by a pivotal shaft 5 supported by a bearing, not illustrated, provided on the cassette body 1*a*.

Figure 3:
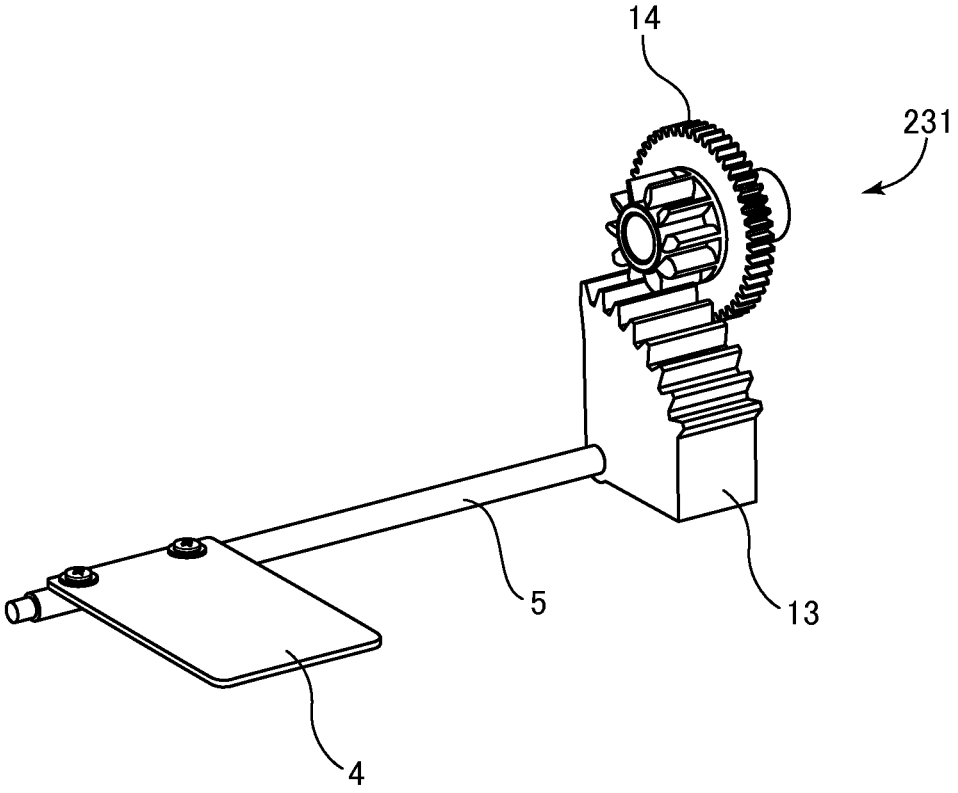
FIG. 3 is an explanatory drawing illustrating an elevating mechanism configured to move a stacking tray of a sheet feed cassette of the full-color laser beam printer of the embodiment upward and downward.
Figure 5:
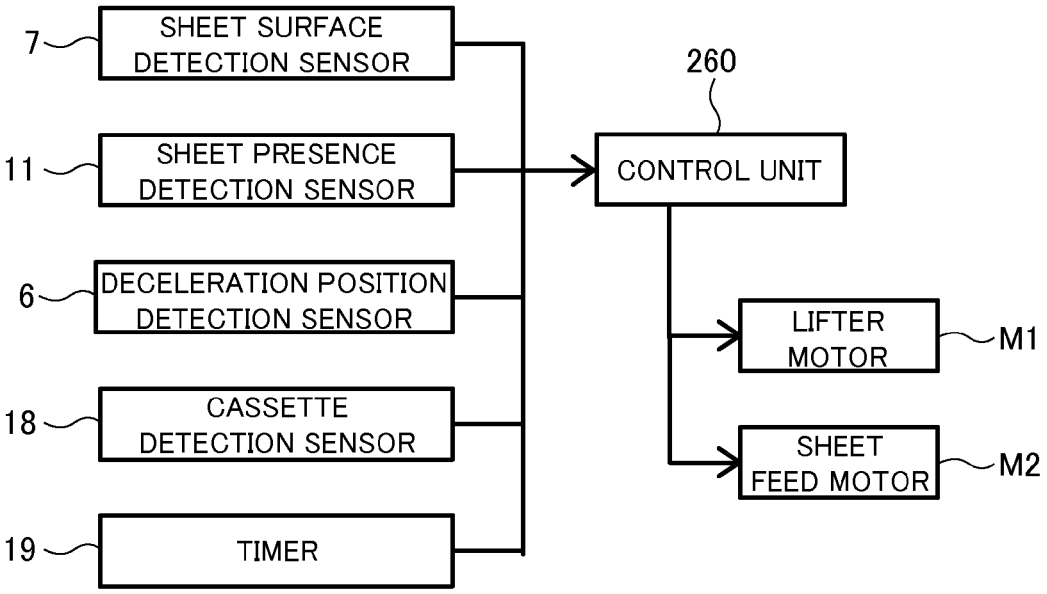
FIG. 5 is a control block diagram of the full-color laser beam printer of the embodiment.

The arm plate 4 is coupled to a fan gear 13 arranged on the back side of the sheet feed cassette 1 via the pivotal shaft 5 as illustrated in FIG. 3. If the sheet feed cassette 1 is pushed in the direction orthogonal to a sheet feeding direction and is mounted on the printer body 201A, the fan gear 13 meshes a lifter gear 14 arranged on the printer body 201A. The lifter gear 14 is rotated by driving of a lifter motor M1 transmitted to the lifter gear 14 via the gear train, not illustrated. The lifter motor M1 has a variable driving speed as illustrated in FIG. 5, which will be described later, as a drive portion.

A rotation of the lifter gear 14 is transmitted to the arm plate 4 via the fan gear 13 and the pivotal shaft 5, and the arm plate 4 is pivoted upward, whereby the stacking tray 2 moves upward. In the embodiment, the lifter motor M1, the lifter gear 14, the arm plate 4, the fan gear 13 as the elevating gear, and the like constitute an elevating mechanism 231 as a drive portion for moving the stacking tray 2 upward and downward by driving of the lifter motor M1.

With the stacking tray 2 moving upward in this manner, the sheet P abuts against the pickup roller 8, and then the pickup roller 8 and the feed roller 9 rotate by a drive force from a sheet feed motor M2 illustrated in FIG. 5 and described later. Accordingly, the sheet P is fed by the pickup roller 8 to a separation nip portion formed by press contact between the feed roller 9 and the retard roller 10. The separation nip portion separates the sheets P piece by piece and conveys the separated sheet to the image forming portion 201B.

Figure 4:
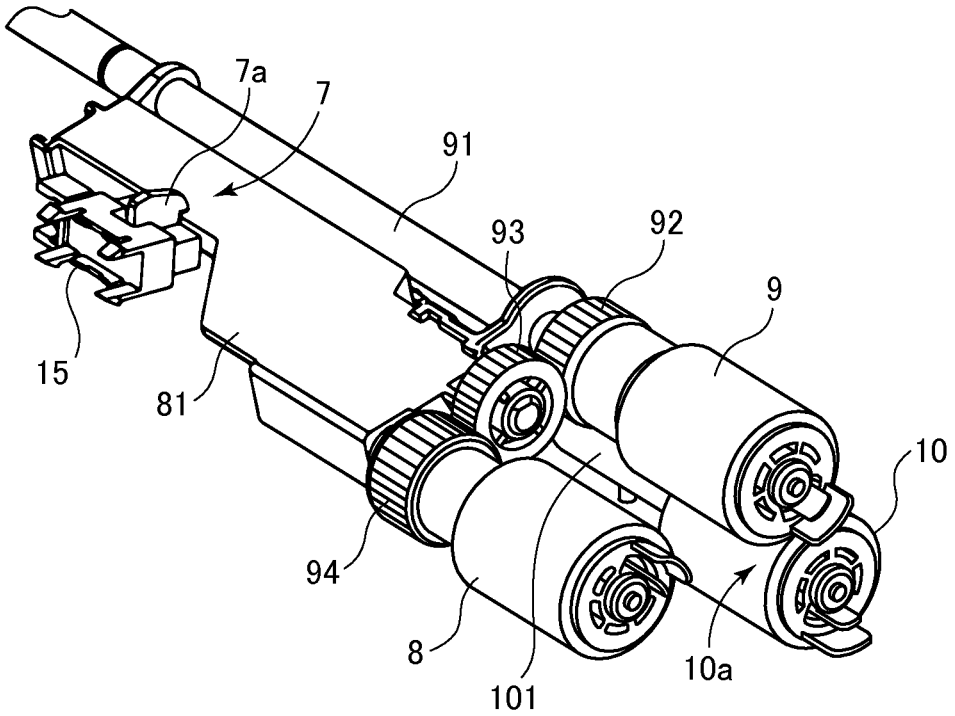
FIG. 4 is an explanatory drawing illustrating a mechanism configured to drive the sheet feed portion of the embodiment.

As illustrated in FIG. 4, the feed roller 9 is mounted on a feed roller shaft 91 as a rotating shaft configured to be rotated by the sheet feed motor M2 as the drive portion illustrated in FIG. 5 described later. The retard roller 10 is rotatably mounted on a retard roller shaft 101 via a torque limiter, not illustrated. In FIG. 4, reference numeral 81 denotes a pickup arm as a holding portion configured to rotatably hold the pickup roller 8 and provided pivotably about the feed roller shaft 91 as a supporting point upward and downward. The pickup arm 81 is biased downward by a biasing member, not illustrated so as to rotate with the pickup roller 8 abutting against a topmost surface of the sheet.

The feed roller shaft 91 is provided with a drive gear 92 mounted thereon. When the feed roller shaft 91 is rotated by the sheet feed motor M2, a roller gear 94 mounted on the pickup roller 8 rotates via the drive gear 92 and an idler gear 93, and the pickup roller 8 rotates. The rotation of the feed roller shaft 91 is transmitted to the retard roller shaft 101 via the drive transmitting mechanism, not illustrated. Accordingly, when the feed roller shaft 91 rotates, the retard roller shaft 101 rotates in the direction opposite to the direction of sheet conveyance (hereinafter, referred to as a reverse feeding direction). When the retard roller shaft 101 rotates, the rotation of the retard roller shaft 101 is transmitted to the retard roller 10 via the torque limiter, and the retard roller 10 rotates in the reverse feeding direction.

In this configuration, when two or more sheets enter the separation nip portion 10*a*, the rotation of the retard roller shaft 101 is transmitted to the retard roller 10 via the torque limiter, and the retard roller 10 rotates in the reverse feeding direction. Accordingly, duplicated feed of the sheets may be prevented. When only one sheet or no sheet enters the separation nip portion 10*a*, a torque caused by a frictional force between the feed roller 9 and the retard roller 10 exceeds a torque which rotates the retard roller 10 of the torque limiter in the reverse feeding direction. In this case, the torque limiter idles, and hence the retard roller 10 rotates in the direction of sheet conveyance by being taken along the feed roller 9, and the sheet is conveyed.

The printer body 201A is provided with a sheet surface detection sensor (sheet detection sensor) 7, a sheet presence detection sensor 11 as illustrated in FIG. 2, and a cassette detection sensor (mounting detection portion) 18 illustrated in FIG. 5. The sheet feed cassette 1 is provided with a deceleration position detection sensor 6. The sheet surface detection sensor 7, the sheet presence detection sensor 11, the deceleration position detection sensor 6, and the cassette detection sensor 18 are connected to the control unit 260 as illustrated in FIG. 5. The sheet surface detection sensor 7 and the deceleration position detection sensor 6 constitute the height detecting portion 16.

A timer 19 as a time counting portion is connected to the control unit 260. The control unit 260 controls driving of the lifter motor M1, the sheet feed motor M2, and the like on the basis of ON/OFF signal of the sheet surface detection sensor 7, the sheet presence detection sensor 11, the deceleration position detection sensor 6, and the cassette detection sensor 18 and time counting information by the timer 19. A pulse motor may be used for the lifter motor M1 as the time counting portion, in this case time is counted on the basis of pulses of the pulse motor.

The sheet surface detection sensor 7 is configured to detect the fact that the stacking tray 2 is lifted and a topmost sheet stacked on the stacking tray 2 reaches a feeding position allowing the pickup roller 8 to feed the sheet. As illustrated in FIG. 4, the sheet surface detection sensor 7 includes a sheet surface detection sensor flag 7*a* composed of part of the pickup arm 81 and a photo sensor 15 turned ON/OFF by the sheet surface detection sensor flag 7*a*. The control unit 260 detects the surface of the sheet on the basis of a detection signal (ON/OFF signal) of the sheet surface detection sensor 7 constituting the sheet detection sensor of the embodiment.

Then when the sheet in the sheet feed cassette 1 moves upward by the stacking tray 2, and the topmost sheet abuts against the pickup roller 8 and pushes up the pickup roller 8, the sheet surface detection sensor flag 7*a* is also pushed upward. Accordingly, the optical axis of the photo sensor 15 is blocked (hereinafter, this state is referred to as OFF). The control unit 260 stops the drive of the lifter motor M1 on the basis of the OFF signal generated by turning OFF the photo sensor 15 to control the lifting amount of the stacking tray 2, so that the height of the sheet surface is optimized. With the shift up operation of the stacking tray 2 in this manner, the topmost sheet waits in contact with the pickup roller 8.

The sheet presence detection sensor 11 is configured to output the detection signal (ON/OFF signal) on the basis of the presence of the sheets stacked in the sheet feed cassette 1. The sheet feed cassette 1 is provided with a sheet presence detection sensor flag 12 configured to be pushed upward by the topmost sheet of the sheets stacked in the stacking tray 2 when the stacking tray 2 is lifted and turns the sheet presence detection sensor 11 ON as illustrated in FIG. 2.

In the case where the sheet is stacked on the stacking tray 2, the stacking tray 2 lifts and the topmost sheet pushes the sheet presence detection sensor flag 12 upward to turn the sheet presence detection sensor 11 ON, whereby the control unit 260 detects the presence of the sheet by this ON signal. If the sheet is not stacked on the stacking tray 2, since the stacking tray 2 is provided with an opening, not illustrated, right below the sheet presence detection sensor flag 12, the sheet presence detection sensor flag 12 is not pushed upward, and the sheet presence detection sensor 11 remains in OFF. When the ON signal is output from the sheet surface detection sensor 7 by detecting the stacking tray 2 and the lifting of the stacking tray 2 is stopped, the control unit 260 detects that no sheet is present on the stacking tray 2, that is, "no-sheet" from the OFF signal of the sheet presence detection sensor 11.

The control unit 260 needs to control the lifter motor M1 and to lift the stacking tray 2 on the basis of the signal from the sheet surface detection sensor 7 to be ready for the sheet feed operation, and to make the stacking tray 2 wait at a position (or a range in the heightwise direction) which brings the height of the sheet surface at an optimal height. However, when stopping the stacking tray 2, since the stacking tray 2 does not stop instantaneously, the stacking tray 2 overruns and may stop at a position higher than the optimal height for the stacking tray 2 to be ready for the sheet feed operation. The amount of overrun is increased as the lifting speed (lifting speed) of the stacking tray 2 increases. The amount of overrun may be reduced by reducing the lifting speed of the stacking tray 2. However, if the lifting speed is reduced, time required for lifting operation of the stacking tray 2 increases. Hence the time to feed sheets by the sheet feeding apparatus 230 and the total time to form images on sheets by the printer 201 are increased.

Therefore, in this embodiment, control to reduce the lifting speed of the stacking tray 2 in the middle of a lifting operation is employed. In other words, at the start of the lifting operation, the stacking tray 2 is lifted at a first lifting speed (normal speed) $V_1$, then at a timing when the topmost sheet approaches the sheet surface detection sensor 7 and gets closer to the a stop position, the lifting speed of the stacking tray 2 is reduced to a second lifting speed (reduced speed) $V_2$, where $V_1>V_2$ to lift the stacking tray 2. By reducing the lifting speed when the stacking tray 2 gets close to the stop position in this manner, the stacking tray 2 may stop quickly without overrunning the stop position and hence the height of the sheet surface may be controlled to an adequate height.

The deceleration position detection sensor 6 is configured to output the signal (ON/OFF signal) for detecting a position to start reduction of the lifting speed of the stacking tray 2. The deceleration position detection sensor 6 configured to detect the decelerating position for reducing the lifting speed of the stacking tray 2 from the first lifting speed $V_1$ to the second lifting speed $V_2$ is arranged above the vicinity of a free end of the stacking tray 2, and includes a light source and a light receiving portion, not illustrated. The light source and the light receiving portion are arranged on facing side plates of the sheet feed cassette 1 so as to face each other in the horizontal direction. The control unit 260 detects the decelerating position on the basis of the detection signal from the deceleration position detection sensor 6.

The positions of the light source and the light receiving portion are determined so that light from the light source is received by the light receiving portion without being blocked when the sheet surface arranged on the stacking tray 2 is low. In the state in which the light is received by the light receiving portion in this manner, an OFF signal is output from the deceleration position detection sensor 6 to the control unit 260. When the height of the sheet surface arranged on the stacking tray 2 is high, light from the light source is blocked by the sheet, and the light cannot be received by the light receiving portion. In the state in which the light cannot be received by the light receiving portion in this manner, an ON signal is output from the deceleration position detection sensor 6 to the control unit 260.

The control unit 260 controls the lifter motor M1 and lifts the stacking tray 2 at the first lifting speed $V_1$ when an OFF signal is output from the deceleration position detection sensor 6. When the deceleration position detection sensor 6 is turned ON in the middle of the upward movement of the stacking tray 2, the stacking tray 2 is decelerated and lifted at a speed of the second lifting speed $V_2$ ($V_1>V_2$). In the embodiment, acceleration and deceleration control of the lifting speed is performed for lifting the stacking tray 2 by switching a PWM control as a drive control method of the lifter motor M1 between ON and OFF. In other words, the lifter motor M1 changes the lifting speed of the stacking tray 2 between the first lifting speed $V_1$ and the second lifting speed $V_2$ described later on the basis of a control signal from the control unit 260.

Figure 6A:
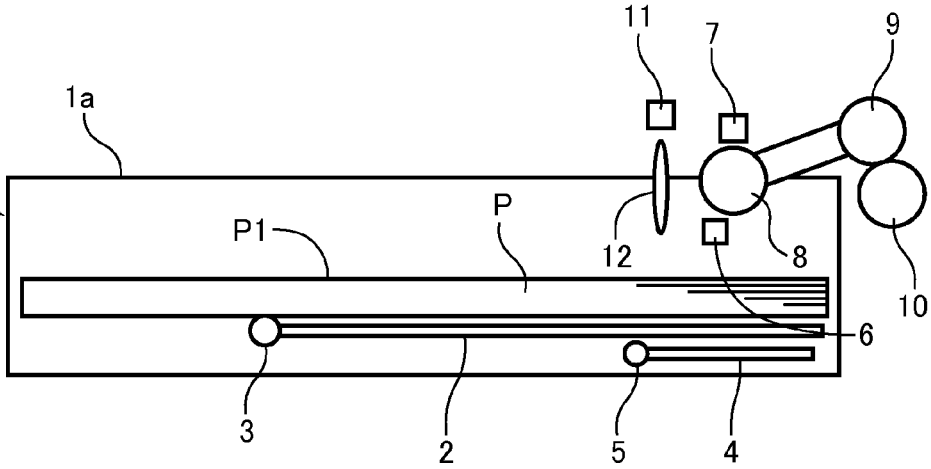
FIG. 6A is a drawing illustrating the sheet feeding apparatus of the embodiment with a small number of sheets stacked thereon and the stacking tray not lifted.
Figure 6B:
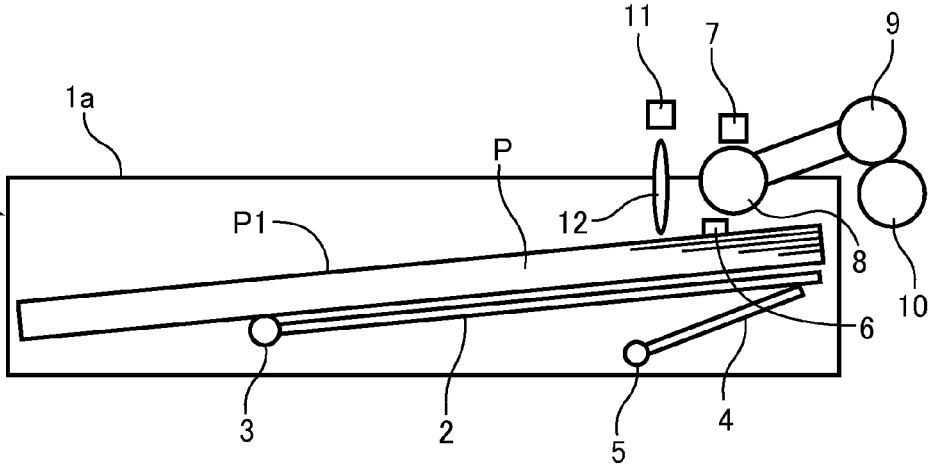
Figure 6C:
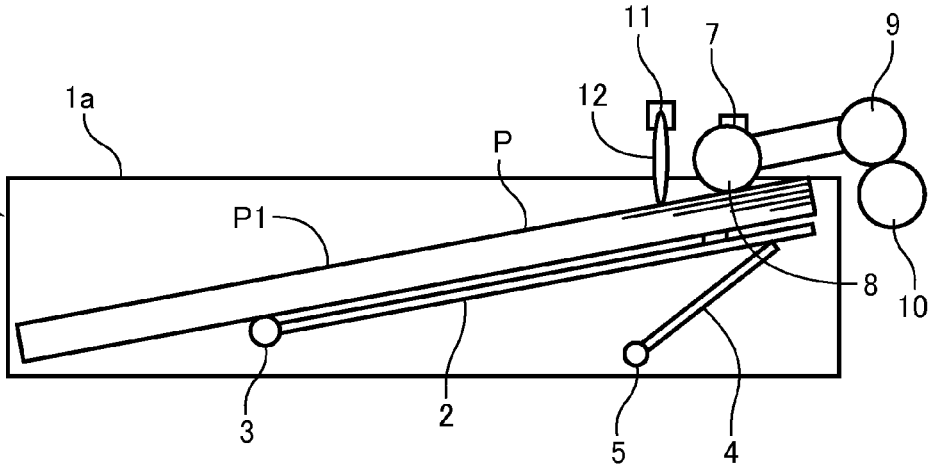
FIG. 6C is a drawing illustrating a state of a sheet surface detection sensor turned ON by stacking a small number of sheets on the sheet feeding apparatus of the embodiment and lifting the stacking tray further upward.

FIG. 6A illustrates the sheet feed cassette 1 having a small number of sheets stacked therein. When a small number of sheets are stacked in the sheet feed cassette 1, the deceleration position detection sensor 6 is OFF at the start of the lifting operation, and hence the stacking tray 2 starts the lifting operation at the first lifting speed $V_1$. Subsequently, as illustrated in FIG. 6B, when the deceleration position detection sensor 6 is turned ON in the middle of the lifting movement of the stacking tray 2, the control unit 260 decelerates the lifter motor M1 and the lifting speed of the stacking tray 2 is reduced, and the lifting operation is performed at the second lifting speed $V_2$. As illustrated in FIG. 6C, a topmost sheet P1 abuts against the pickup roller 8 and pushes up the pickup roller 8. When the sheet surface detection sensor 7 is turned ON, the lifting operation of the stacking tray 2 is stopped and the stacking tray 2 is ready for the start of the sheet feed operation.

Figure 7A:
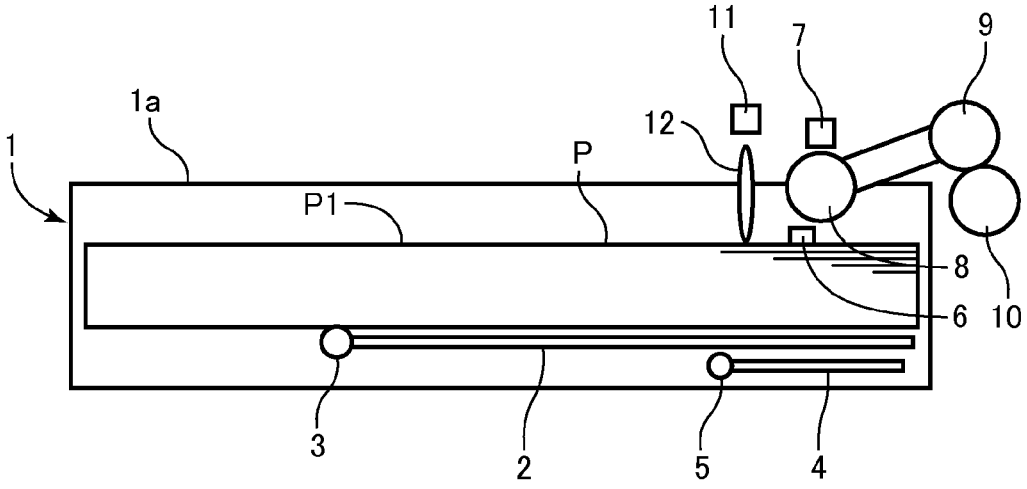
FIG. 7A is a drawing illustrating a state of the sheet feeding apparatus of the embodiment with a large number of sheets stacked thereon and the stacking tray not lifted.
Figure 7B:
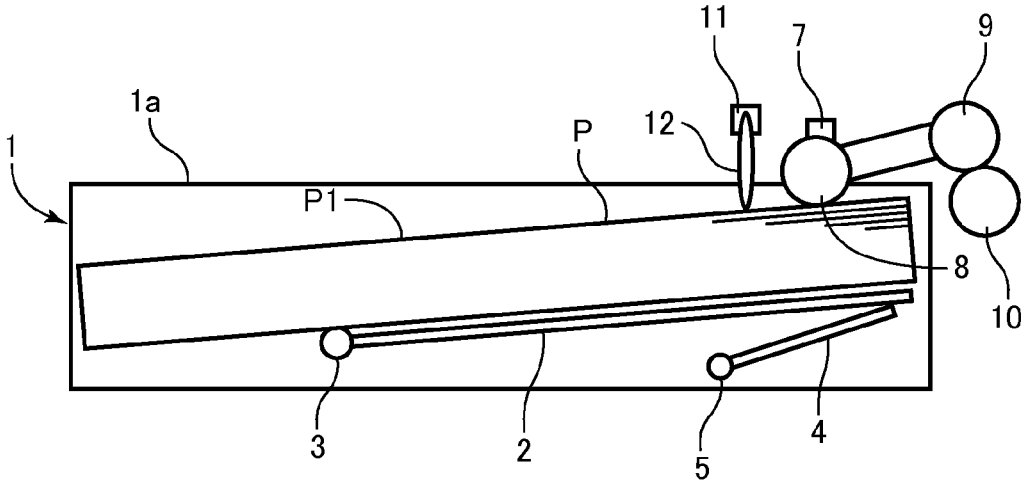
FIG. 7B is a drawing illustrating a state of the sheet surface detection sensor turned ON by stacking a large number of sheets on the sheet feeding apparatus of the embodiment and lifting the stacking tray upward.

FIG. 7A illustrates the sheet feed cassette 1 having almost full of sheets stacked therein. In this state, the deceleration position detection sensor 6 is already ON when the sheet feed cassette 1 is inserted into the printer body 210A and before the lifting operation is started. Therefore, the lifting operation is started at the second lifting speed $V_2$ that is the reduced speed from the start of the lifting operation. As illustrated in FIG. 7B, the topmost sheet P1 abuts against the pickup roller 8 and pushes up the pickup roller 8. When the sheet surface detection sensor 7 is turned ON, the lifting operation is terminated and the stacking tray 2 is ready for the start of the sheet feed operation. In other words, when the control unit 260 detects the fact that the sheet feed cassette 1 is mounted on the printer body 201A on the basis of the detection signal from the cassette detection sensor 18, if the deceleration position detection sensor 6 outputs the detection signal (ON signal), the control unit 260 controls the lifter motor M1 and lifts the stacking tray 2 at the second lifting speed $V_2$.

Figure 8A:
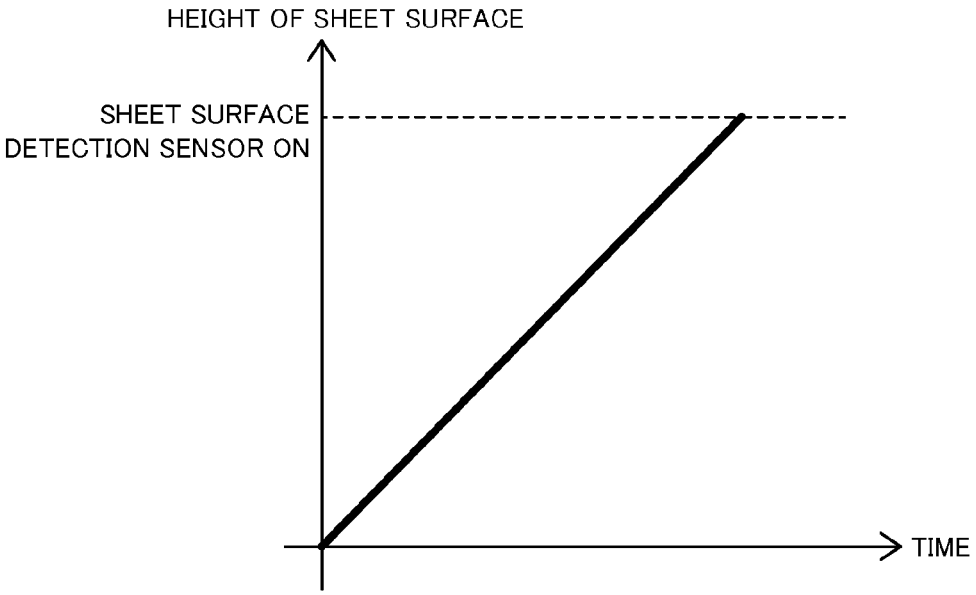
FIG.8A PRIOR ART
FIG. 8A is a drawing illustrating a relationship between a sheet lifting time and a height of the sheet surface in a sheet feeding apparatus of the related art.
Figure 8B:
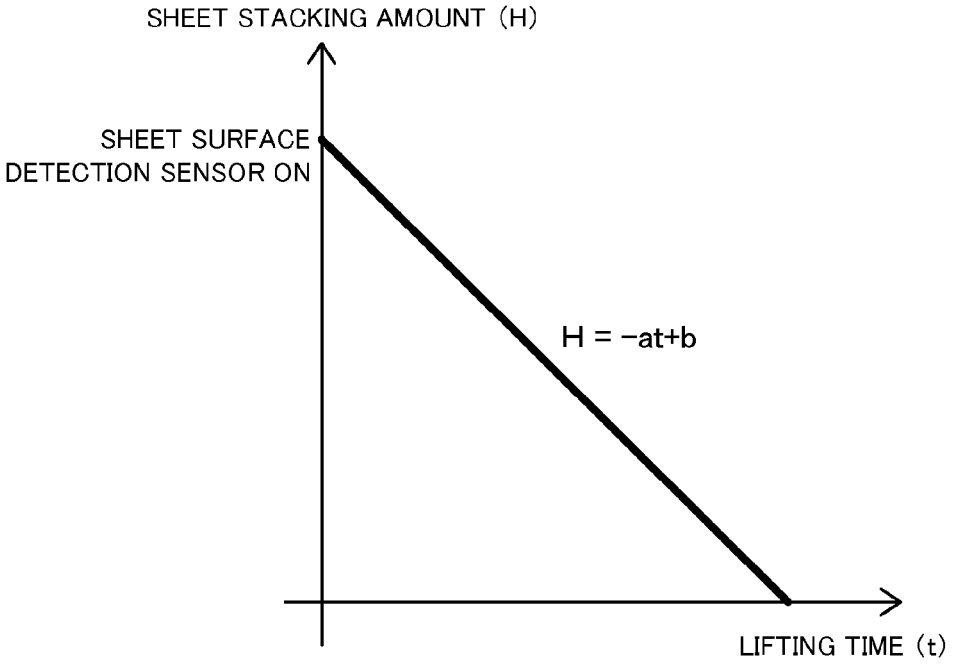
FIG.8B PRIOR ART
FIG. 8B is a drawing illustrating a relationship between a lifting time and a sheet stacking amount in the sheet feeding apparatus of the related art.

In the embodiment, the timer 19 (the time counting portion) counts the counted value (lifting time) of lifting the stacking tray 2, and the control unit 260 computes a sheet stacking amount from the counted value and the lifting speed of the stacking tray 2. Here, as the related art illustrated in FIG. 8A, when the lifting speed of the stacking tray 2 is a constant speed, a relationship between a lifting time (t) and a sheet stacking amount (H) may be computed by using a linear function having t as a variable and expressed by H=−at +b as illustrated in FIG. 8B. Signs a and b each indicate a constant in the linear function. The constant a is calculated from the lifting speed, and the constant b is calculated form the height when the sheet surface detection sensor 7 is ON. In this manner, in the image forming apparatus configured to compute the sheet stacking amount by using an arithmetic expression expressed by the linear function, the sheet stacking amount may be computed with high degree of accuracy if the lifting speed of the stacking tray 2 is constant.

Figure 9A:
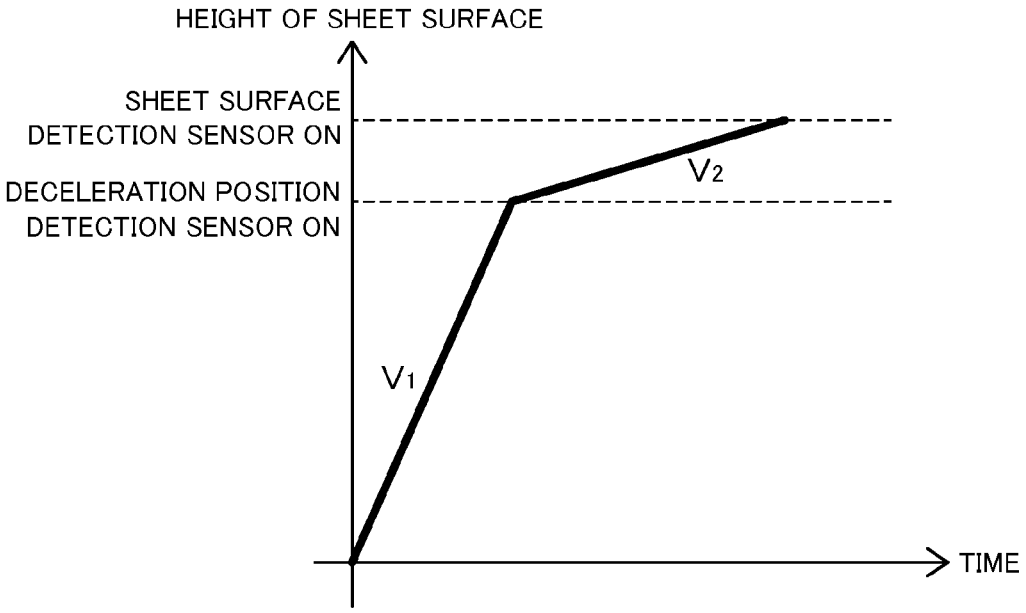
FIG. 9A is a drawing illustrating an ideal relationship between a sheet lifting time and a height of the sheet surface in the sheet feeding apparatus of the embodiment.
Figure 9B:
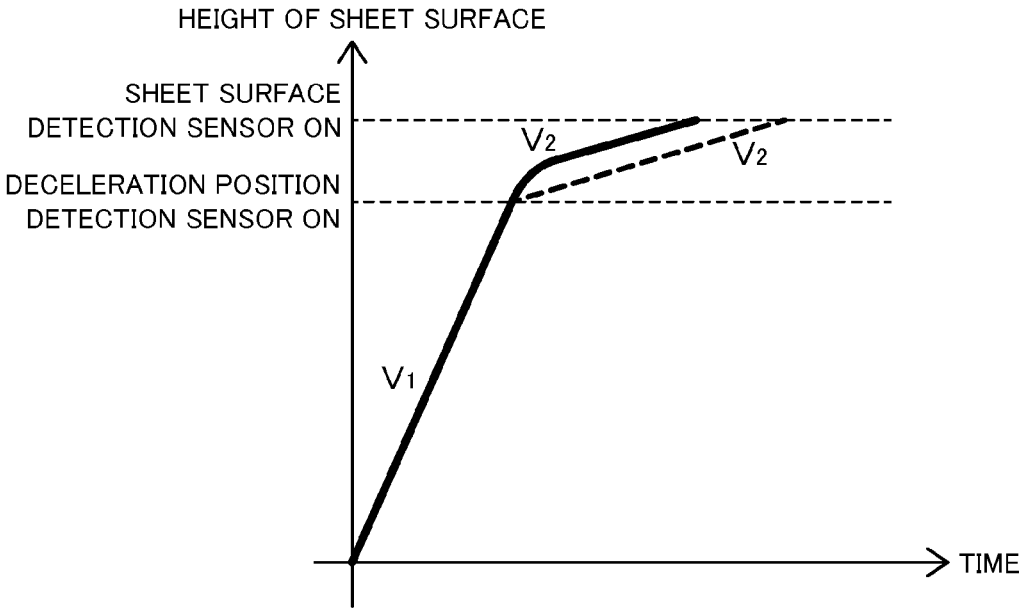
FIG. 9B is a drawing illustrating an actual relationship between the sheet lifting time and the height of the sheet surface in the sheet feeding apparatus of the embodiment.

However, in the embodiment, the lifting speed of the stacking tray 2 is reduced in the middle of the upward movement of the stacking tray 2 as described already. In this manner, in the case where the lifting speed of the stacking tray 2 is changed in the middle the lifting operation, if the sheet stacking amount is computed simply by a linear function, there arises a difference between the computed sheet stacking amount and an actual sheet stacking amount, and accurate detection of the sheet stacking amount cannot be achieved. When reducing the lifting speed of the stacking tray 2 here, the lifting speed is ideally reduced from the first lifting speed $V_1$ to the second lifting speed $V_2$ at the same time as the deceleration position detection sensor 6 turns ON as illustrated in FIG. 9A. Actually, however, as illustrated in FIG. 9B, the lifting speed is changed from the first lifting speed $V_1$ to the second lifting speed $V_2$ after an elapse of deceleration for a certain time after the deceleration position detection sensor has turned ON.

In contrast, when the sheet is fully stacked and the deceleration position detection sensor 6 is already ON when the lifting operation of the stacking tray 2 is started as illustrated in FIG. 7A, the lifting speed is not reduced in the middle of the lifting operation. In other words, if the deceleration position detection sensor 6 is ON at the time when the lifting operation of the stacking tray 2 is started, the stacking tray 2 is lifted at a speed of the second lifting speed $V_2$ indicated by a broken line in FIG. 9B.

Figure 10A:
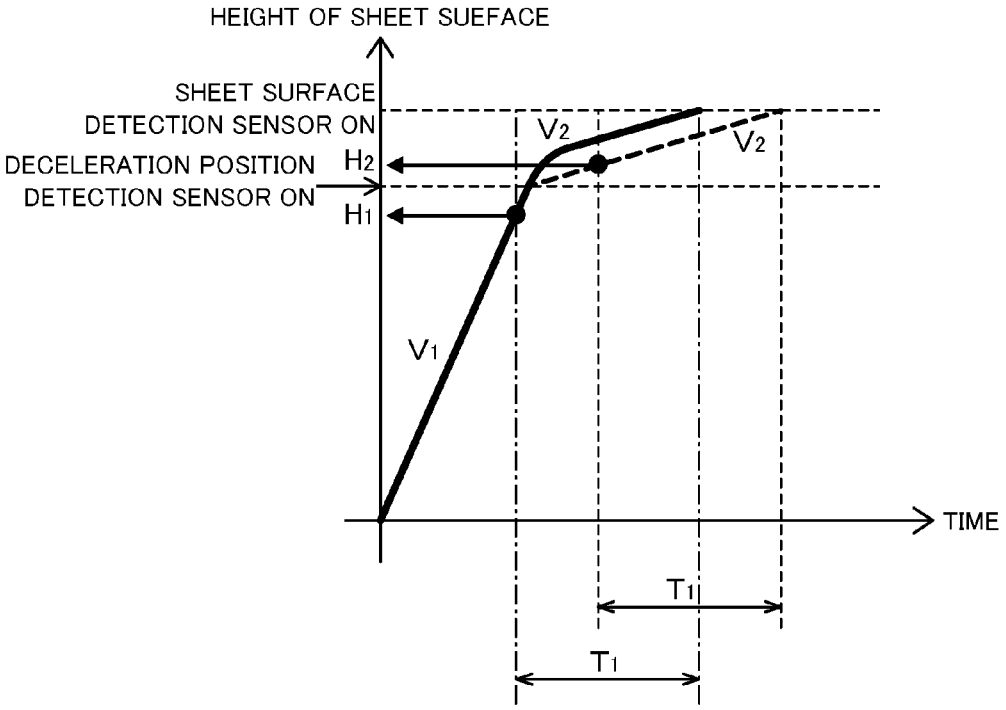
FIG. 10A is a drawing illustrating an actual relationship between the sheet lifting time and the height of the sheet surface and an example of the case where the lifting time is the same with different sheet stacking amounts according to the sheet feeding apparatus of the embodiment.

As illustrated in FIG. 10A, for example, if the stacking tray 2 is lifted at a speed of the second lifting speed $V_2$ when the height of the sheet surface at the start of the lifting operation is a height $H_2$ slightly higher than that of the deceleration position detection sensor 6, time required from the start to the end of the lifting operation is $T_1$. In contrast, when the height of the sheet surface at the start of the lifting operation is a height $H_1$ slightly lower than that of the deceleration position detection sensor 6, time required from the start of lifting operation until the end of the lifting operation is $T_1$. In other words, if the stacking heights $H_1$, $H_2$ as the heights of the sheet surface at the start of the lifting operation, that is, the sheet stacking amount is a height in the vicinity of the deceleration position detection sensor 6, the lifting time $T_1$ from the start of the lifting operation until the sheet reaches the feeding position is the same. In other words, even though the lifting time $T_1$ is the same, the sheet stacking amount may be different and hence the sheet stacking amount cannot be computed on the basis of the lifting time $T_1$.

Figure 10B:
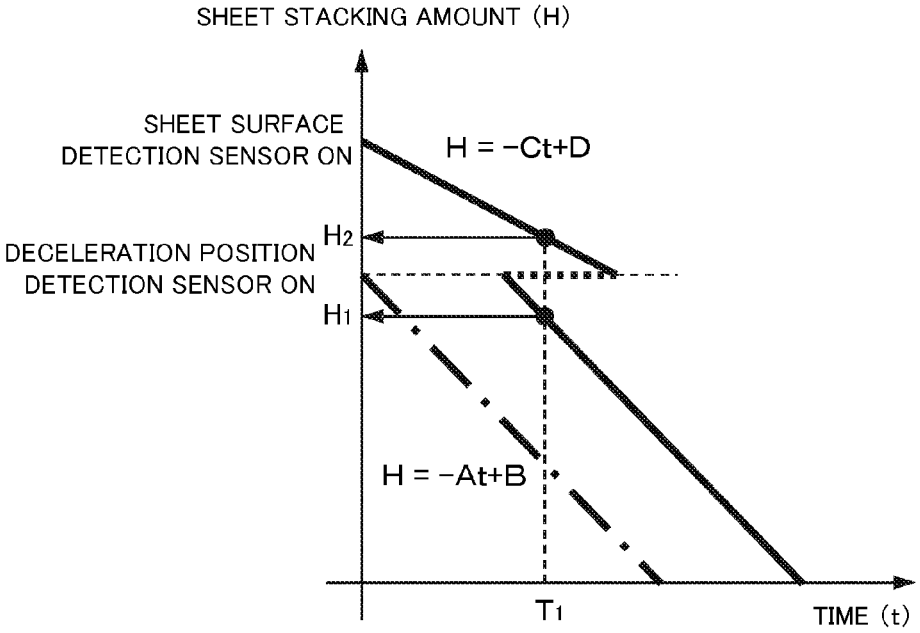
FIG. 10B is a drawing illustrating a relationship between the sheet lifting time and the sheet stacking amount in the sheet feeding apparatus of the embodiment.

The relationship illustrated in FIG. 10A is expressed as a solid line in FIG. 10B with the sheet stacking amount (H) indicated on a vertical axis and the lifting time (t) indicated on a lateral axis. The relationship between the lifting time (t) up to the feeding position and the sheet stacking amount (H) differs depending on whether the sheet stacking amount is larger or smaller than the ON position of the deceleration position detection sensor 6. In other words, from the solid line in FIG. 10B, it is understood that the relationship between the lifting time (t) and the sheet stacking amount (H) differs depending on whether or not the lifting speed is reduced in the middle of the lifting movement of the stacking tray 2, that is, the deceleration position detection sensor 6 is ON or OFF at the time of insertion of the sheet feed cassette 1. Therefore, if the relationship between the lifting time (t) and the sheet stacking amount (H) is computed with a simple linear function as being expressed by H=−at+b illustrated in FIG. 8B, the difference between the actual sheet stacking amount and the sheet stacking amount obtained by computation is increased, and an accurate computation of the sheet stacking amount cannot be achieved.

Accordingly, in the embodiment, the control unit 260 prepares two (a plurality of) arithmetic expressions of the sheet stacking amount, and uses one of the two arithmetic expressions of the sheet stacking amount depending on ON or OFF of the deceleration position detection sensor 6 at the time of insertion of the sheet feed cassette 1. For example, if the deceleration position detection sensor 6 is ON at the time of insertion of the sheet feed cassette 1, the sheet stacking amount (H) is computed by a first arithmetic expression expressed by H=−Ct+D illustrated in FIG. 10B by using the time (t) from the start of the lifting operation until the sheet surface detection sensor 7 is turned ON. As illustrated by a chain line in FIG. 10B, if the deceleration position detection sensor 6 is OFF at the time of insertion of the sheet feed cassette 1, the time (t) from the start of the lifting operation until the deceleration position detection sensor 6 is turned ON is counted instead of the lifting time from the start of the lifting operation until the sheet surface detection sensor 7 is turned ON to compute the sheet stacking amount (H) by using the time (t). In other words, if the deceleration position detection sensor 6 is OFF at the time of insertion of the sheet feed cassette 1, the time (t) from the start of the lifting operation until the deceleration position detection sensor 6 is turned ON is used to compute the sheet stacking amount (H) by using a second arithmetic expression expressed by H=−At+B illustrated in FIG. 10B. Accordingly, if the deceleration position detection sensor 6 is OFF at the time of insertion of the sheet feed cassette 1, the sheet stacking amount may be computed by approximating only the first lifting speed $V_1$ as the lifting speed by the linear function. Therefore, the computing accuracy of the sheet stacking amount may be improved in comparison with the case where the sheet stacking amount is computed by approximating a plurality of speeds as the lifting speed by the linear function.

In the second arithmetic expression H=−At+B and the first arithmetic expression H=−Ct+D, A is the first lifting speed $V_1$ (a lifting speed before deceleration) and C is the second lifting speed $V_2$ (a lifting speed after deceleration). B is a constant on the basis of the heightwise position of the deceleration position detection sensor 6 and, in this embodiment, B is a constant determined by the height which turns the deceleration position detection sensor 6 ON. D is a constant on the basis of the heightwise position of the sheet surface detection sensor 7 and, in this embodiment, D is a constant determined by the height which turns the sheet surface detection sensor 7 ON. In this manner, the computation of the sheet stacking amount with high degree of accuracy can be achieved by computing the sheet stacking amount (H) by the first arithmetic expression or the second arithmetic expression by turning the deceleration position detection sensor 6 ON/OFF.

Figure 11:
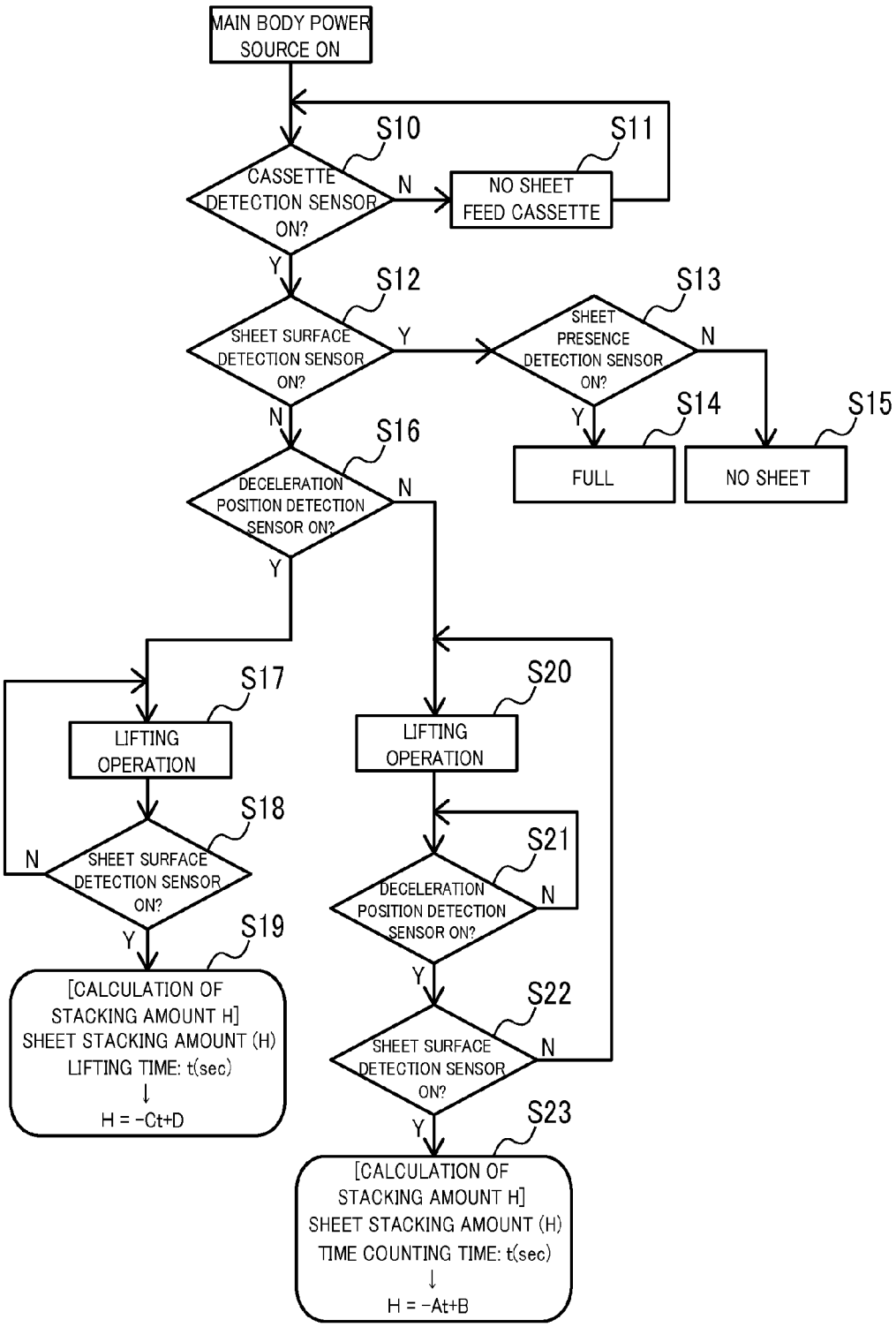
FIG. 11 is a flowchart for explaining computation of the sheet stacking amount of the sheet feeding apparatus of the embodiment.

Subsequently, arithmetic control of the sheet stacking amount will be described with reference to the flowchart in FIG. 11. First of all, when the power source of the printer 201 is turned ON, the control unit 260 detects whether or not the sheet feed cassette 1 is mounted on the printer body 201A depending on ON/OFF of the cassette detection sensor 18 (S10). Then, if the cassette detection sensor 18 is ON (Y in S10), the control unit 260 detects that the sheet feed cassette 1 is mounted on the printer body 201A. When the control unit 260 detects that the sheet feed cassette 1 is mounted, whether or not the topmost sheet in the sheet feed cassette 1 is at the feeding position is determined by the sheet surface detection sensor 7 before starting the lifting operation (moving-upward operation) of the stacking tray 2 (S12). If the cassette detection sensor 18 is not ON (N in S10), the control unit 260 determines that the sheet feed cassette 1 is not present (S11), alerts a user that the sheet feed cassette 1 is not mounted by indicating an alert on an operating portion, a monitor and so on, and waits until the sheet feed cassette 1 is mounted on the printer body 201A (S10).

When the sheet surface detection sensor 7 is ON (Y in S12), the control unit 260 determines that the sheet surface is at an adequate height and, subsequently, the sheet presence detection sensor 11 detects the presence of the sheet in the sheet feed cassette 1 (S13). If the sheet presence detection sensor 11 is ON (Y in S13), the control unit 260 then determines that the sheet in the sheet feed cassette 1 is full (S14), and when the sheet presence detection sensor 11 is OFF (N in S13), no sheet is present within the sheet feed cassette 1 (no-sheet) (S15).

When the sheet surface detection sensor 7 is not ON (N in S12), the control unit 260 determines whether or not the deceleration position detection sensor 6 is ON (S16). When the deceleration position detection sensor 6 is ON (Y in S16), the control unit 260 determines to compute the sheet stacking amount by the first arithmetic expression, and when the deceleration position detection sensor 6 is OFF (N in S16), the control unit 260 determines to compute the sheet stacking amount by the second arithmetic expression.

After the arithmetic expression configured to compute the sheet stacking amount has been determined in this manner, if the deceleration position detection sensor 6 is ON (Y in S16), the control unit 260 drives the lifter motor M1 to lift the stacking tray 2 at a speed of the second lifting speed $V_2$ (S17) and waits until the sheet surface detection sensor 7 turns ON (S18). When the sheet surface detection sensor 7 is turned ON (Y in S18), in other words, when the sheet reaches the feeding position, the control unit 260 performs a process of calculating a sheet stacking amount H on the basis of the detection signal from the sheet surface detection sensor 7 (S19). In other words, the control unit 260 counts time t from the start of the lifting operation through turning ON of the sheet surface detection sensor 7 until the lifting operation of the stacking tray 2 is terminated with the timer 19, and computes the sheet stacking amount (sheet remaining amount) H by a counted value (lifting time t) counted by the timer 19 and the first arithmetic expression ($H=-Ct+D$).

When the deceleration position detection sensor 6 is turned OFF (N in S16), the control unit 260 drives the lifter motor M1 to lift the stacking tray 2 at a speed of the first lifting speed $V_1$ (S20). Accordingly, the stacking tray 2 lifts and in a meanwhile, the deceleration position detection sensor 6 detects the sheet and is turned ON (Y in S21), and then the control unit 260 drives the lifter motor M1 to lift the stacking tray 2 at a speed of the second lifting speed $V_2$ and waits until the sheet surface detection sensor 7 is turned ON (S22). If the sheet surface detection sensor 7 is turned ON (Y in S22), the control unit 260 performs a process of calculating the sheet stacking amount H (S23). Here, the control unit 260 counts time t from the start of the lifting operation until the deceleration position detection sensor 6 is ON, and computes the sheet stacking amount (sheet remaining amount) H by the counted value (lifting time t counted by the timer 19) and the second arithmetic expression ($H=-At+B$).

In this manner, in the embodiment, the control unit 260 computes the sheet stacking amount by using the first arithmetic expression when the deceleration position detection sensor 6 detects the sheet, and computes the sheet stacking amount by using the second arithmetic expression when the deceleration position detection sensor 6 does not detect the sheet. In other words, the sheet stacking amount of the stacking tray 2 is computed on the basis of the times taken for the deceleration position detection sensor 6 or the sheet surface detection sensor 7 to detect the sheet, whereby the accurate detection of the sheet stacking amount can be achieved without adding any other sensors.

The description given thus far describes the case where the stacking tray 2 is lifted at a speed of the first lifting speed $V_1$ to a position just before the feeding position and then the lifting speed is reduced to a speed of the second lifting speed $V_2$ on the basis of the detection signal of the deceleration position detection sensor 6. However, this disclosure is not limited thereto. For example, the stacking tray 2 may be configured to lift the sheet at a plurality of lifting speeds to a position just before the feeding position and provided with a plurality of the deceleration position detection sensors. In this case, the accuracy of computation of the sheet stacking amount may be increased by using three or more arithmetic expressions to compute the sheet stacking amount from the lifting time and the lifting speed.

In addition, the description given thus far describes the case where the presence of the sheet on the stacking tray is detected by the control unit 260 on the basis of the detection signal from the sheet presence detection sensor 11. However, this disclosure is not limited thereto, and the sheet presence detection sensor 11 may not be provided or, for example, the presence of the sheet may be detected by a height detecting portion 16. For example, if the stacking tray 2 having no sheet stacked therein lifts, the stacking tray 2 turns the sheet surface detection sensor 7 ON via the pickup roller 8. At this time, the stacking tray 2 is at a position higher than the deceleration position detection sensor 6, and hence the control unit 260 detects that the deceleration position detection sensor 6 is OFF. In this manner, even though the lifting operation of the stacking tray 2 is started and the sheet surface detection sensor 7 is turned ON, if the deceleration position detection sensor 6 does not detect the sheet, the fact that no sheet is present on the stacking tray 2 can be detected. In other words, detection of the presence of the sheet can be achieved by the deceleration position detection sensor 6 and the sheet surface detection sensor 7. And the sheet presence detection sensor 11 can be used as the deceleration position detection sensor 6. In other words, when the sheet presence detection sensor 11 outputs the ON signal by detecting the sheet on the stacking tray 2, the control unit 260 determines that the topmost sheet reaches the decelerating position and may control the lifter motor M1 to change the lifting speed of the stacking tray 2 from the first lifting speed to the second lifting speed. In these cases, a cost is reduced because of a reducing sensors.

In addition, the description given thus far describes the case where the control unit 260 computes the sheet stacking amount every time when the lifting operation of the stacking tray 2 is started irrespective of ON and OFF of the deceleration position detection sensor 6. However, this disclosure is not limited thereto. For example, the control unit 260 may be configured to compute the sheet stacking amount only when the deceleration position detection sensor 6 is OFF at the start of lifting operation of the stacking tray 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-227164, filed Oct. 31, 2013 which is hereby incorporated by reference herein in its entirety.

What is claimed is:

1. An image forming apparatus comprising:

a sheet storage portion drawably mounted on an apparatus body and having a sheet stacking portion configured to stack sheets and to be movable upward and downward;

a sheet feed portion provided above the sheet storage portion and configured to feed the sheets;

a drive portion configured to lift the sheet stacking portion until the sheets stacked on the sheet stacking portion reach a feeding position allowing the sheet feed portion to feed the sheets and configured to switch a lifting speed when lifting the sheet stacking portion to the feeding position between a first lifting speed and a second lifting speed slower than the first lifting speed;

a height detecting portion configured to detect the fact that the sheets reach a decelerating position where the lifting speed of the sheet stacking portion is switched from the first lifting speed to the second lifting speed during a period from a start of lifting of the sheet stacking portion until the sheets stacked on the sheet stacking portion reach the feeding position, the height detecting portion configured to detect the fact that the sheet stacked on the sheet stacking portion reaches the decelerating position and the feeding position;

a time counting portion configured to count a lifting time of the sheet stacking portion; and a control unit configured to compute a sheet stacking amount of the sheet stacking portion by using the lifting time from the start of lifting of the sheet stacking portion until the sheets stacked on the sheet stacking portion reach the decelerating position counted by the time counting portion and the first lifting speed in a case that the sheets are lifted to the decelerating position by the drive portion at the first lifting speed and then are lifted to the feeding position at the second lifting speed, wherein the control unit computes the sheet stacking amount of the sheet stacking portion by using lifting time from a start of the lifting operation of the sheet stacking portion counted by the time counting portion until the sheet reaches the feeding position and the second lifting speed in a case that the lifting speed of the sheet stacking portion is set at the second lifting speed in response to the height detecting portion detecting the sheet stacked on the sheet stacking portion being positioned at the decelerating position before the lifting operation of the sheet stacking portion is started by the drive portion.

2. The image forming apparatus according to claim 1, wherein the control unit computes the sheet stacking amount with an arithmetic expression expressed by $-At+B$ where A is the first lifting speed, B is a constant on the basis of a heightwise position of the decelerating position, and t is the lifting time counted by the time counting portion from the start of the lifting operation of the sheet stacking portion until the sheet reaches the decelerating position in a case that the fact that the sheet reaches the decelerating position is not detected by the height detecting portion before the lifting operation of the sheet stacking portion is started by the drive portion, and the control unit computes the sheet stacking amount with an arithmetic expression expressed by $-Ct+D$ where C is the second lifting speed, D is a constant on the basis of a heightwise position of the feeding position, and t is the lifting time counted by the time counting portion from the start of the lifting operation of the sheet stacking portion until the sheet reaches the feeding position in a case that the fact that the sheet reaches the decelerating position is detected by the height detecting portion before the lifting operation of the sheet stacking portion is started by the drive portion.

3. The image forming apparatus according to claim 1, further comprising:

a deceleration position detection sensor configured to output a detection signal when the sheet stacked on the sheet stacking portion reaches the decelerating position, wherein the height detecting portion includes a sheet detection sensor configured to output a detection signal when the sheet stacked on the sheet stacking portion reaches the feeding position.

4. The image forming apparatus according to claim 3, wherein the control unit determines that no sheet is present on the sheet stacking portion in a case that the deceleration position detection sensor is unable to detect the sheet in a state in which the sheet detection sensor detects the sheet.

5. The image forming apparatus according to claim 3, wherein the height detecting portion includes a sheet presence detection sensor configured to output an ON/OFF signal on the basis of presence or absence of the sheet stacked on the sheet stacking portion, and the control unit determines that no sheet is present on the sheet stacking portion in a case that the ON signal is output from the sheet detection sensor the OFF signal is output from the sheet presence detection sensor, and the control unit detects that the sheet reaches the decelerating position in a case that the ON signal is output from the sheet presence detection sensor.

6. The image forming apparatus according to claim 1, wherein the drive portion switches the lifting speed of the sheet stacking portion between the first lifting speed and the second lifting speed on the basis of a control signal from the control unit.

7. The image forming apparatus according to claim 1, further comprising:

a mounting detection portion detecting that the sheet storage portion is mounted on the apparatus body, wherein the height detecting portion detects the fact that the sheets on the sheet stacking portion reach a decelerating position or not in a case that the mounting detection portion detects that the sheet storage portion is mounted on the apparatus body.

8. An image forming apparatus comprising:

a sheet storage portion having a sheet stacking portion configured to stack the sheet and movable upward and downward;

a sheet feed portion provided above the sheet storage portion and configured to feed the sheets;

a sheet detection sensor configured to output a detection signal in a case that a topmost sheet on the sheet stacking portion reaches the feeding position by the lifting operation of the sheet stacking portion;

a deceleration position detection sensor configured to output a detection signal in a case that the topmost sheet on the sheet stacking portion reaches a prescribed height between a height of a position to start lifting operation of the sheet stacking portion and a height of the feeding position;

a drive portion configured to lift the sheet stacking portion at a first lifting speed or at a second lifting speed slower than the first lifting speed;

a time counting portion configured to count time elapsed from a start of a lifting operation of the sheet stacking portion; and a control unit configured to control the drive portion to lift the sheet stacking portion at the first lifting speed before the deceleration position detection sensor outputs the detection signal, and at the second lifting speed after the deceleration position detection sensor outputs the detection signal until the sheet detection sensor outputs the detection signal, and compute the sheet stacking amount of the sheet stacking portion on the basis of time from a start of the lifting operation of the sheet stacking portion until an output of the detection signal from the deceleration position detection sensor and the first lifting speed.

9. The image forming apparatus according to claim 8, wherein the control unit is configured to control the drive portion to lift the sheet stacking portion at the second lifting speed in a case that the deceleration position detection sensor outputs the detection signal before a start of lifting the sheet stacking portion by the drive portion, and compute the sheet stacking amount of the sheet stacking portion on the basis of time from a start of the lifting operation of the sheet stacking portion until the detection signal is output from the sheet detection sensor.

10. The image forming apparatus according to claim 9, wherein the control unit computes the sheet stacking amount with an arithmetic expression expressed by $-At+B$ where A is the first lifting speed, B is a constant on the basis of a heightwise position of the decelerating position detection sensor, and t is time counted by the time counting portion in a case that the deceleration position detection sensor does not output the detection signal before the start of the lifting operation of the sheet stacking portion, and computes the sheet stacking amount with an arithmetic expression expressed by $-Ct+D$ where C is the second lifting speed, D is a constant on the basis of a heightwise position of the sheet detection sensor, and t is time counted by the time counting portion in a case that the deceleration position detection sensor outputs the detection signal before the start of the lifting operation of the sheet stacking portion.

11. The image forming apparatus according to claim 8, wherein the control unit is configured to control the drive portion to lift the sheet stacking portion at the second lifting speed in a case of that the deceleration position detection sensor outputs the detection signal before the start of the lifting operation of the sheet stacking portion, and the control unit is configured to control the drive portion to start lifting the sheet stacking portion at the first lifting speed in a case of that the deceleration position detection sensor does not output the detection signal, and to reduce the lifting speed to the second lifting speed in a case of that the deceleration position detection sensor outputs the detection signal.

* * * * *